US006394050B1

(12) United States Patent
McCarthy et al.

(10) Patent No.: US 6,394,050 B1
(45) Date of Patent: May 28, 2002

(54) ACTUATOR PISTON ASSEMBLY FOR A ROCKER ARM SYSTEM

(75) Inventors: Donald J. McCarthy, Wethersfield, CT (US); Richard J. Little, Jr., Montgomery, MA (US); Dennis R. Custer, West Granby, CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/663,412

(22) Filed: Sep. 15, 2000

Related U.S. Application Data

(60) Provisional application No. 60/154,020, filed on Sep. 15, 1999.

(51) Int. Cl.[7] ..... F01L 1/00

(52) U.S. Cl. ..... 123/90.1; 123/90.39; 123/90.45; 123/90.16

(58) Field of Search ..... 123/90.1, 90.12, 123/90.39, 90.42, 90.45, 90.15, 90.16, 198 F, 90.41

(56) References Cited

U.S. PATENT DOCUMENTS 3,220,392 A 11/1965 Cummins
4,204,512 A * 5/1980 Brock, Jr. ..... 123/198 F
4,387,680 A * 6/1983 Tsunetomi et al. ..... 123/198 F
4,539,953 A * 9/1985 Sasaki et al. ..... 123/90.41
4,598,674 A * 7/1986 Nono et al. ..... 123/90.41
4,617,880 A * 10/1986 Yoshizaki ..... 123/90.16
4,676,203 A * 6/1987 Nouno ..... 123/90.42
4,706,620 A * 11/1987 Gill ..... 123/90.45
4,867,112 A * 9/1989 Ishii ..... 123/90.45
5,048,480 A * 9/1991 Price ..... 123/90.16
5,146,890 A 9/1992 Gobert et al.
5,586,531 A 12/1996 Vittorio
5,626,116 A 5/1997 Reedy et al.
6,276,315 B1 * 8/2001 Chiyouji et al. ..... 123/90.1

* cited by examiner

*Primary Examiner*—Teresa Walberg
*Assistant Examiner*—Fadi H. Dahbour
(74) *Attorney, Agent, or Firm*—John N. Coulby; Mark W. Rygiel; Collier Shannon Scott, PLLC

(57) ABSTRACT

The present invention is directed to an actuator piston assembly for use in a rocker arm system. The actuator piston assembly is capable of actuating at least one engine valve during for example engine braking. The actuator piston assembly includes a piston body having a hollow interior, a screw assembly received within the hollow interior of the screw assembly, a biasing assembly for biasing the piston body with respect to the screw assembly, a cap assembly located within the hollow interior, wherein the biasing assembly interacts with the cap assembly and the screw assembly, and a securing assembly for movably securing the piston body to the screw assembly.

15 Claims, 1 Drawing Sheet

ACTUATOR PISTON ASSEMBLY FOR A ROCKER ARM SYSTEM

CROSS-REFERENCE TO RELATED APPLICATIONS

This application is related to U.S. patent application Ser. No. 09/165,291, and claims priority on Provisional Patent Application No. 60/154,020, file on Sep. 15, 1999, the specifications of which is incorporated herein by reference.

FIELD OF THE INVENTION

The present invention relates generally to an actuator piston assembly for use on a rocker arm system in an engine. In particular, the present invention relates to the construction of an actutaor piston assembly that can take up a preset lash and be easily manufactured.

BACKGROUND OF THE INVENTION

With many engines it is desirable to have both a positive power mode of operation (in which the engine produces power for such purposes as propelling an associated vehicle) and a braking mode operation (in which the engine absorbs power for such purposes as slowing down an associated vehicle). It is well known that a highly effective way of operating an engine in braking mode is to cut off the fuel supply to the engine and to then open the exhaust valves in the engine near top dead center of the compression strokes of the engine cylinders. This allows air that the engine has compressed in its cylinders to escape to the exhaust system of the engine before the engine can recover the work of compressing the air during the subsequent "power" strokes of the engine pistons. This type of engine braking is known as compression release engine braking.

It takes a great deal more force to open an exhaust valve to produce a compression release event during compression release engine braking than to open either an intake or exhaust valve during positive power mode operation of the engine. During positive power mode operation the intake valves typically open while the piston is moving away from the valves, thereby creating a low pressure condition in the engine cylinder. Thus the only real resistance to intake valve opening is the force of the intake valve return spring which normally holds the intake valve closed. Similarly, during positive power mode operation the exhaust valves typically open near the end of the power strokes of the associated piston after as much work as possible has been extracted from the combustion products in the cylinder. The piston is again moving away from the valves and the cylinder pressure against which the exhaust valves must be opened is again relatively low. (Once opened, the exhaust valves are typically held open throughout the subsequent exhaust stroke of the associated piston, but this only requires enough force to overcome the exhaust valve return spring force.)

The additional exhaust valve opening associated with compression release retrading is achieved by adding components that actuate an exhaust valve independently from the normal actuating mechanisms. This is typically achieved by actuating the lifting mechanism of the exhaust valve by way of a secondary hydro-mechanical system that can be deactivated when the engine is operating in its positive power mode. In summary, the secondary system lifts the exhaust valve, at an appropriate time, and does not interfere with, nor interrupt, the normal valve lifting mechanism, and is inactive during positive power operation. Timing of the secondary system's valve lifting is usually derived from the activation of an adjacent cylinder's normal intake or exhaust valve's opening or the injection actuation mechanism. A neighboring cylinder, wherein a valve opening occurs nearest to the desired time for the active cylinder's exhaust valve opening is chosen. This approach, deriving timing from an adjacent cylinder's normal operation, eliminates the need for the secondary system to contain its own timing control.

The most common type of engine brake derives its motion from the injector cam of the same cylinder.

Conventional single-cycle engine braking systems have inherent limitations. These limitations are introduced primarily by (1) secondary valve actuating systems derive their timing from an adjacent cylinder's normal valve opening timing via hydromechanical links; and (2) secondary systems do not interrupt the normal opening and closing of the cylinder intake and exhaust valves during positive power. The first circumstance generally results in a sub-optimum realization of the full engine braking potential. This occurs because the timing and duration of the exhaust valve opening to vent the cylinder at the completion of the compression braking stroke is fixed by an adjacent cylinder's normal timing or injector timing of that cylinder during valve opening duration. The second circumstance prevents exploiting a second compression braking cycle because the exhaust valve is open during the exhaust stroke. Otherwise, the second cycle is available for compression braking Consequently, a system that takes control of the actuation of the cylinder intake and exhaust valves enables or disables their opening. This can optimize engine performance in an engine braking mode.

Other internal combustion engine limitations have emerged in the thirty years since engine braking technology has been introduced. Emission controls, turbo-chargers, and exhaust braking have affected the performance of engine braking. The net effect is a reduction in conventional engine braking performance, particularly at low speeds when the turbo-charged air volume, available for compression, is small. During the same time, demand and reliance on conventional engine braking has increased. A further motivation for improved engine braking performance has emerged.

Engine retarders of the compression release-type are well-known in the art. Engine retarders are designed to convert, at least temporarily, an internal combustion engine of either the spark-ignition or compression-ignition type into an air compressor. In doing so, the engine develops retarding horsepower to help slow the engine down. This can provide the operator increased control over the vehicle, and substantially reduce wear on the service brakes of the vehicle. A properly designed and adjusted compression release-type engine retarder can develop retarding horsepower that is a substantial portion of the operating horsepower developed by the engine on positive power.

A compression release-type retarder of this type supplements the braking capacity of the primary vehicle wheel braking system. In so doing, it extends substantially the life of the primary (or wheel) braking system of the vehicle. The basic design for a compression release engine retarding system of the type involved with this invention is disclosed in Cummins, U.S. Pat. No. 3,220,392.

The compression release-type engine retarder disclosed in the Cummins '392 patent employs a hydraulic control system. The hydraulic control system of typical compression release-type engine retarders used prior to the present invention engage the valve actuation system of the engine. When the engine is under positive power, the hydraulic control system of a typical compression release engine retarder is disengaged from the valve control system. When compression release-type retarding is desired, the fuel supply is stopped and the hydraulic control system of the compression release brake causes the compression release brake to engage the valve control system of the engine.

Compression release-type engine retarders typically employ a hydraulic system in which a master piston engages the valve control or injector system of the engine. When the retarder is activated, a solenoid valve allows lube oil to fill a hydraulic circuit which actuates the master piston which is hydraulically connected to a slave piston. The motion of the master piston controls the motion of the slave piston, which in turn typically opens the exhaust valve of the internal combustion engine at a point near the end of the compression stroke. In doing so, the work that is done in compressing the intake air cannot be recovered during the subsequent expansion (or power) stroke of the engine. Instead, it is dissipated through the exhaust. By dissipating energy developed from the work done in compressing the intake gases, the compression release-type retarder dissipates energy from the engine, slowing the vehicle down.

The master piston in typical compression release engine retarders of the type known prior to the present invention is typically driven by a push tube that is controlled by the engine camshaft. The force required to open the exhaust valve is transmitted back through the hydraulic system to the push tube and the camshaft. Historically, it has been desirable to minimize modification of the engine, as many compression release-type retarders were installed as after market items. Accordingly, a push tube that otherwise moves at a point in the engine cycle close to the desired time to operate the compression release engine retarder was typically selected for actuating the master piston. In some cases, an exhaust valve push tube associated with another engine cylinder was selected. In yet other cases, it was convenient to use the fuel injector cam lobe or push tube associated with the cylinder that was undergoing the compression event. It is also possible to use an intake valve push tube. Additionally, there are other ways to operate the master piston.

Regardless of the specific actuation means chosen, inherent limits were imposed on operation of the compression release-type retarder based on the allowable loads on the engine. A number of mechanical factors have historically imposed limitations: the temperature of critical engine parts, such as valves; the seating velocity of the valves; push tube loads; cam stress; the power available from the compression release retarder to overcome the instantaneous cylinder pressure at the point of opening and a variety of other factors. Typically, it is desired to-open the compression release-type engine retarder as late in the engine cycle as possible. In this way, the engine develops a higher degree of compression, allowing more energy to be dissipated through the compression release retarder. Delaying the opening of the exhaust valve in the compression release event to a point later in the compression stroke, however, also increased substantially the loading placed on critical engine components.

Safety, reliability and environmental demands have pushed the technology of compression release engine retarding significantly over the past 30 years. Compression release retarding systems are typically adapted to a particular engine in order to maximize the retarding horsepower that could be developed, consistent with the mechanical limitations of the engine system. In addition, over the decades during which these improvements were made, compression release-type engine retarders garnered substantial commercial success. Engine manufacturers became more willing to embrace compression release retarding technology. Compression release-type retarders have continued to enjoy substantial and continuing commercial success in the marketplace. Accordingly, engine manufacturers have been more willing to make engine design modifications, in order to accommodate the compression release-type engine retarder, as well as to improve its performance and efficiency.

In addition to these pressures, significant environmental pressures have forced engine manufacturers to explore a variety of new ways to improve the efficiency of their engines. These changes have forced a number of engine modifications. Engines have become smaller and more fuel efficient. Yet, the demands on retarder performance have often increased, requiring the compression release-type engine retarder to generate greater amounts of retarding horsepower under more limiting conditions. A variety of ancillary equipment are currently employed on diesel type engines, including turbo-chargers, silencers, exhaust brakes, waste gate controls, electronic controls, sensors and other collateral apparatus.

Similarly, in an effort to secure greater performance, an engine may have a turbocharger. Another method of vehicle engine retarding has included the use of any device that causes a restriction in the turbo, or in which a restriction is imposed in the exhaust manifold, increasing the back pressure on the engine and making it harder for the piston to force gases out of the cylinder on the exhaust stroke. During the past decades many engine manufacturers, and operators, have used an exhaust restriction method on a turbo-charged engine in combination with a compression release-type retarder. The use of the exhaust restrictor, however, essentially "kills" the boost available from the turbo-charger, dramatically reducing the amount of air delivered to the engine on intake. This, in turn dramatically worsens compression release-type engine brake performance. Combination braking does result in an overall increase in retarding due to the practical effect of getting more air into the cylinder.

As the market for compression release-type engine retarders has developed and matured, these multiple factors have pushed the direction of technological development toward a number of goals: securing higher retarding horsepower from the compression release retarder; increasing mid-range performance and variable retarding capability; working with, in some cases, lower masses of air deliverable to the cylinders through the intake system; and the inter-relation of various collateral or ancillary equipment, such as: turbo-chargers; and exhaust brakes. In addition, as the market for compression release engine retarders has matured and moved from the after-market to original equipment manufacturers, engine manufacturers have shown an increased willingness to make design modifications to their engines that would increase the performance and reliability, and broaden the operating parameters, of the compression release-type engine retarder.

Volvo has also employed exhaust gas recirculation. Gobert et al., U.S. Pat. No. 5,146,890 for Method and a Device for Engine Braking a Four Stroke Internal Combustion Engine, discloses the addition of an exhaust gas recirculation lobe on the cam. The engine has for each cylinder at least one inlet valve and at least one exhaust valve for controlling communication between a combustion chamber in the cylinder and an inlet system and an exhaust system, respectively. The arrangement also establishes communication between the combustion chamber and the exhaust system in conjunction with the exhaust stroke and also when the piston is located in the proximity of its bottom-dead-center position after the inlet stroke and during the latter part of the compression stroke and during at least part of the expansion stroke. Communication of the combustion chamber with the exhaust system is effected upstream of a throttling device provided in the exhaust system, this throttling device being operative to throttle at least a part of the flow through the exhaust system during an engine braking operation, therewith to increase the pressure upstream of the throttling device. The exhaust gas recirculation lobe on the Volvo cam, however, is at a different cam timing than the exhaust gas recirculation of the present invention. Moreover, nothing in the Volvo '890 patent teaches or suggests two-cycle braking.

In a typical four-stroke internal combustion engine, the intake rocker arm and exhaust rocker arms have dedicated cam lobes. Historically, engine manufacturers have been reluctant to modify their engine configurations to provide a dedicated cam lobe for the compression release-type brake. In addition, on fuel injected engines, the fuel injector requires additional space on the cam shaft for the fuel injector cam lobe. This configuration has historically limited the amount of space available to provide additional cams to actuate the compression release brake system. The availability of a dedicated cam for the compression release brake system would simplify and improve the operation, reliability, and performance of the compression release-type braking system. Insufficient space has typically been available on the cam shaft, however, to accomplish that objective.

Recently, some manufacturers have begun manufacturing engines with two overhead cam shafts. This provides a greater overall amount of space along the cam shaft to use cams to directly actuate engine components. For example, one engine manufacturer has recently adopted a dual overhead cam shaft design. In the new engine, the fuel injector cam is located on a separate cam shaft, to provide a greater contact length along the cam to operate the fuel injector. This frees additional space along the second valve actuation cam shaft to provide cams that are dedicated to the operation of the compression release-type brake. It is in this type of situation that the present invention has particular application. As embodied herein, the present invention uses a dedicated cam to directly actuate a rocker arm for the compression release-type engine retarder, thereby eliminating push tubes and other associated hardware. This simplifies installation and maintenance of the brake and improves its reliability by reducing the number of parts that are susceptible to failure and, in particular, particularly high stress parts such as push tubes.

In addition, some engine manufacturers have attempted to redesign the overhead of the engine to employ a dedicated compression brake cam. For example, certain model engines feature overhead cam shafts. Engine manufacturers have redesigned the overhead of certain of its engine models to incorporate a dedicated brake cam compression release. For example, Vittorio, U.S. Pat. No. 5,586,531, assigned to Cummins Engine Company, discloses an engine retarder cycle for an engine in which the exhaust valve is opened earlier during the compression stroke than previously contemplated. Vittorio discloses beginning the opening of a retarder valve in an engine cylinder during a second halt of a compression stroke of a piston in the engine cylinder. By opening the retarder valve earlier, the cylinder pressure is not allowed to build to as high a level as previously attained. The retarder valve is opened to a maximum displacement prior to a top dead center position of the piston. The retarder valve is then closed during the first half of the expansion stroke of the piston. Reedy et al., U.S. Pat. No. 5,626,116, assigned to Cummins Engine Company, discloses a dedicated rocker lever and cam assembly for a compression braking system. The Reedy dedicated rocker lever and cam assembly operates according to the method described in the Vittorio '531 patent. The braking system includes an independent exhaust valve actuator assembly having a braking mode rocker lever and a cam lobe for imparting movement to the exhaust valve when the engine is operated in the braking mode.

OBJECTS OF THE INVENTION

It is another object of the present invention to provide an improved actuator piston assembly for a rocker arm system.

It is another object of the present invention to provide an improved actuator piston assembly for a rocker arm system that eliminates problems associated with welding conventional actuator pistons.

It is another object of the present invention to provide an improved actuator piston assembly for a rocker arm system that can be manufactured at reduced cost.

It is another object of the present invention to provide an improved actuator piston assembly for a rocker arm system eliminates contamination from grinding.

SUMMARY OF THE INVENTION

The present invention is directed to an actuator piston assembly for use in a rocker arm system. The actuator piston assembly is capable of actuating at least one engine valve during, for example, engine braking. The actuator piston assembly includes a piston body having a hollow interior, a screw assembly received within the hollow interior of the piston body, a biasing assembly for biasing the piston body with respect to the screw assembly, a cap assembly located within the hollow interior, wherein the biasing assembly interacts with the cap assembly and the screw assembly, and a securing assembly for movably securing the piston body to the screw assembly.

The securing assembly may include a plurality of balls located between the piston body and the cap assembly for movably securing the piston body to the screw assembly. The securing assembly may further include a groove located within the piston body, wherein at least a portion of the plurality of balls are located within the groove.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

The invention will be described in conjunction with the following drawing in which like reference numerals designate like elements and wherein.

DETAILED DESCRIPTION OF THE PREFERRED EMBODIMENTS

Figure 1:
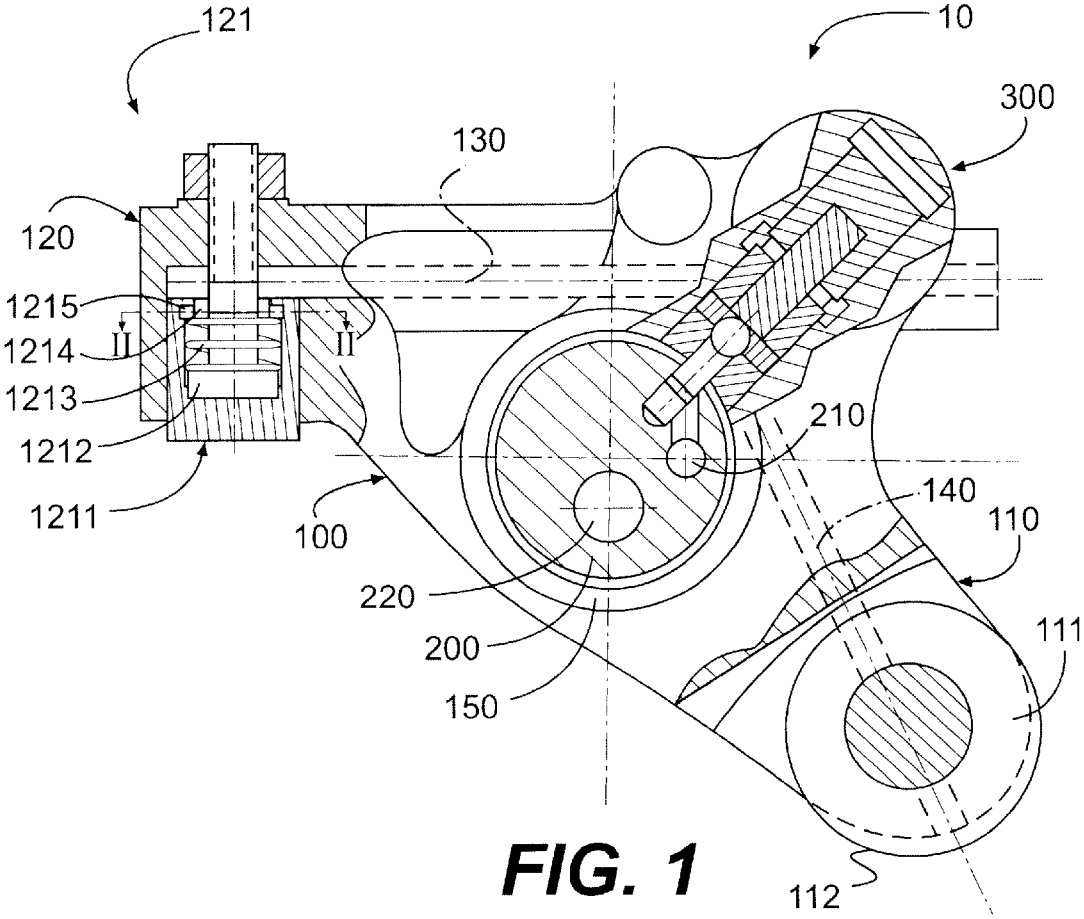
FIG. 1 is a side view of a rocker arm system for an engine brake having an improved actuator piston assembly in accordance with an embodiment of the present invention.
Figure 2:
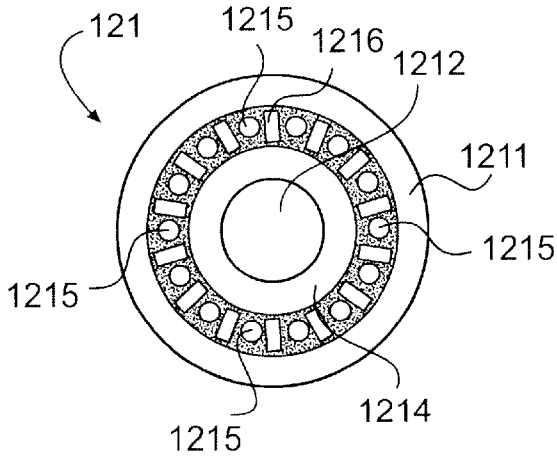
FIG. 2 is a cross-section of the actuator piston assembly along line II—II of FIG. 1.

FIG. 1 depicts a rocker arm system 10 in accordance with the present invention. The rocker arm system 10 includes a rocker arm assembly 100 that is rotatably mounted on a rocker shaft 200. The brake rocker arm system 10 also includes a locking assembly 300 for releasably securing the rocker arm assembly 100 to the shaft 200. The rocker arm assembly 100 and the rocker shaft 200 will now be described.

The rocker arm assembly 100 pivots about the rocker shaft 200 and includes a first end 110 and a second end 120. The first end 110 of the rocker arm assembly 100 includes a cam lobe follower 111. The cam lobe follower 111 may include a roller follower 112 that is in contact with a brake cam lobe, not shown. It, however, is contemplated that other means for transferring energy from an energy source to the rocker arm assembly are considered to be well within the scope of the present invention.

The second end 120 of the rocker arm assembly 100 includes an actuator piston assembly 121. The actuator assembly 121 is spaced from the crosshead of at least one valve, not shown. When activated, the rocker arm assembly 100 and the actuator piston assembly 121 contact the crosshead pin, not shown, of the crosshead to open the at least one exhaust valve to perform a braking operation.

The rocker arm assembly 100 also includes a fluid passageway 130 that extends from the actuator piston assembly 121. Fluid from a passageway 210 in the shaft 200 may be supplied to the fluid passageway 130 to operate the actuator piston assembly 121. The supply of fluid is preferably a high pressure supply. A solenoid valve, not shown, may be mounted to the shaft 200 to control the flow of fluid within the passageway 210. Alternatively, the solenoid valve may be mounted on the rocker arm. The rocker arm assembly 100 also includes a fluid passageway 140 that extends to the follower 111 and a fluid passageway 150 that extends around the periphery of the shaft 200. The fluid from the passageway 210 in the shaft 200 may be supplied to the fluid passageway 140 to lubricate the follower 111. The fluid from a passageway 220 in the shaft 200 may also be supplied to the fluid passageway 150 to provide lubrication between the rocker arm assembly 100 and the shaft 200 to provide smooth operation of the rocker arm assembly 100.

The locking assembly 300 is described in U.S. patent application Ser. No. 09/165,291, entitled "Improved Brake Release Assembly With Hydraulic Lock," the specification of which is incorporated herein by reference.

The actuator piston assembly 121 will now be described in greater detail. The advantage of the actuator piston assembly 121 is that it can be assembled without welding and the compromise of material selection necessary for the welding process.

The function of the actuator piston assembly 121 is to take up a preset valve lash in the arm system 10. The actuator piston assembly 121 may be used in connection with engine braking so as to activate the braking function. As shown in FIG. 1, the actuator piston assembly 121 comprises a piston body 1211, a screw assembly 1212, a spring assembly 1213 surrounding the screw assembly 1212, a cap assembly 1214 and a plurality of balls 1215. The spring assembly 1213 is positioned between the cap assembly 1214 and the end of the screw assembly 1212, as shown in FIG. 1.

The piston body 1211 is a close fit in a bore in the rocker arm assembly 100 and the screw assembly 1212 is threaded into the rocker arm assembly 100 so that the initial position of the actuator piston assembly 121 may be adjusted and fixed. When the braking, for example, is activated, pressurized fluid is supplied through fluid passageway 130 and the piston body 1211 extends, compressing the spring assembly 1213, until the cap assembly 1214 stops against the head of the screw assembly 1212 and is in position to contact the engine valve stem.

The innovation of the present invention is the design of the actuator piston assembly 121 so that the components may be easily manufactured on standard machinery and assembled without sophisticated equipment. The spring assembly 1213, which returns the piston body 1211 to its at rest position against the head of the screw assembly 1212 when the brake is deactivated, works between the screw assembly 1212 and the cap assembly 1214.

The plurality of balls 1215, which are trapped between a groove 1216 in the piston body 1211 and a flange on the cap assembly 1214, prevents the cap assembly 1214 from moving. The actuator piston assembly 121 is assembled by depressing the cap assembly 1214 against the spring assembly 1213 far enough to expose the groove in the piston body 1211 and dropping in the plurality of balls 1215 therein. When the cap assembly 1214 is released the plurality of balls 1215 is trapped, retaining the cap assembly 1214.

The present invention eliminates problems associated with assembling conventional actuator pistons, in particular problems associated with necessary welding processes including but not limited to cost, contamination from grinding after welding, undetected welding flaws, spring damage due to welding heat, and material selection. While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An actuator piston assembly capable of actuating at least one engine valve, said actuator piston assembly comprising:

a piston body having a hollow interior;

a screw assembly received within said hollow interior of said piston body;

biasing means for biasing said piston body with respect to said screw assembly;

a cap assembly located within said hollow interior, wherein said biasing means interacts with said cap assembly and said screw assembly; and securing means located between said piston body and said cap assembly for movably securing said piston body to said screw assembly.

2. The actuator piston assembly according to claim 1, wherein said securing means comprises a plurality of balls located between said piston body and said cap assembly for movably securing said piston body to said screw assembly.

3. The actuator piston assembly according to claim 2, wherein said securing means further includes a groove located within said piston body, wherein at least a portion of said plurality of balls are located within said groove.

4. The actuator piston assembly according to claim 1, wherein said biasing means comprises a spring assembly.

5. An actuator piston assembly for use in a rocker arm system, said actuator piston assembly being capable of actuating at least one engine valve, said actuator piston assembly comprising:

a piston body having a hollow interior;

a screw assembly received within said hollow interior of said piston body;

biasing means for biasing said piston body with respect to said screw assembly;

a cap assembly located within said hollow interior, wherein said biasing means interacts with said cap assembly and said screw assembly; and securing means located between said piston body and said cap assembly for movably securing said piston body to said screw assembly.

6. The actuator piston assembly according to claim 5, wherein said securing means comprises a plurality of balls located between said piston body and said cap assembly for movably securing said piston body to said screw assembly.

7. The actuator piston assembly according to claim 6, wherein said securing means further includes a groove located within said piston body, wherein at least a portion of said plurality of balls are located within said groove.

8. The actuator piston assembly according to claim 5, wherein said biasing means comprises aspring assembly.

9. An actuator piston assembly for use in a rocker arm system, said actuator piston assembly being capable of actuating at least one engine valve during engine braking, said actuator piston assembly comprising:

a piston body having a hollow interior;

a screw assembly received within said hollow interior of said piston body;

biasing means for biasing said piston body with respect to said screw assembly;

a cap assembly located within said hollow interior, wherein said biasing means interacts with said cap assembly and said screw assembly; and securing means located between said piston body and said cap assembly for movably securing said piston body to said screw assembly.

10. The actuator piston assembly according to claim 9, wherein said securing means comprises a plurality of balls located between said piston body and said cap assembly for movably securing said piston body to said screw assembly.

11. The actuator piston assembly according to claim 10, wherein said securing means further includes a groove located within said piston body, wherein at least a portion of said plurality of balls are located within said groove.

12. The actuator piston assembly according to claim 9, wherein said biasing means comprises a spring assembly.

13. An actuator piston assembly capable of actuating at least one engine valve, said actuator piston assembly comprising:

a piston body having a hollow interior;

a screw assembly received within said hollow interior of said piston body;

biasing means for biasing said piston body with respect to said screw assembly;

a cap assembly located within said hollow interior, wherein said biasing means interacts with said cap assembly and said screw assembly; and a plurality of balls located between said piston body and said cap assembly for movably securing said piston body to said screw assembly.

14. The actuator piston assembly according to claim 13, wherein at least a portion of said plurality of balls are located within a groove located within said piston body.

15. The actuator piston assembly according to claim 13, wherein said biasing means comprises a spring assembly.

* * * * *